US010465674B2

(12) United States Patent
Pines et al.

(10) Patent No.: US 10,465,674 B2
(45) Date of Patent: Nov. 5, 2019

(54) METHOD AND SYSTEM FOR DETERMINING A PUMP SETPOINT

(75) Inventors: Assaf Pines, Ness Ziona (IL); Erez Heldy, Ness Ziona (IL); Jonathan Nir, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 2136 days.

(21) Appl. No.: 13/559,437

(22) Filed: Jul. 26, 2012

(65) Prior Publication Data

US 2014/0030113 A1 Jan. 30, 2014

(51) Int. Cl.

| | |
|---|---|
| ***F04B 49/06*** | (2006.01) |
| ***F04B 47/06*** | (2006.01) |
| ***F04B 51/00*** | (2006.01) |
| ***F04D 15/00*** | (2006.01) |

(52) U.S. Cl.

CPC ..... *F04B 47/06* (2013.01); *F04B 49/065* (2013.01); *F04B 51/00* (2013.01); *F04D 15/0088* (2013.01); *F04B 2205/09* (2013.01)

(58) Field of Classification Search

CPC ..... F04B 49/065; F04B 51/00; F04B 2203/0209; F04B 2205/09; F04B 47/06; F04D 15/0218; F04D 15/0088

See application file for complete search history.

(56) References Cited

U.S. PATENT DOCUMENTS 3,524,978 A * 8/1970 Iwata et al. ..... 358/1.6
3,722,545 A * 3/1973 Furlani ..... F16K 5/0605 137/625.3
4,108,574 A * 8/1978 Bartley et al. ..... 417/19
4,467,258 A * 8/1984 Leuthen ..... 318/800
4,678,404 A * 7/1987 Lorett et al. ..... 417/45
5,107,441 A 4/1992 Decker
5,213,477 A * 5/1993 Watanabe et al. ..... 417/20
5,240,380 A * 8/1993 Mabe ..... 417/43
5,307,288 A * 4/1994 Haines ..... 702/47
5,497,664 A * 3/1996 Jorritsma ..... G01F 1/007 73/861
5,601,413 A * 2/1997 Langley et al. ..... 417/12
5,815,175 A 9/1998 Seikel
6,325,093 B1 * 12/2001 Ooshima ..... 137/392
6,330,525 B1 12/2001 Hays et al.

(Continued)

OTHER PUBLICATIONS

Flow of Fluids through Valves, Fittings and Pipe. Stamford, CT: Crane, 2013. N. pag. Print. TP-410. pp. i-vii, 5-1-5-5, 6-4-6-7 and A-30.*

(Continued)

*Primary Examiner* — Patrick Hamo
*Assistant Examiner* — Joseph S. Herrmann
(74) *Attorney, Agent, or Firm* — Fabian VanCott

(57) ABSTRACT

A method for determining a pump setpoint for delivering a desired volumetric flow rate of a substance through a channel comprises measuring a first volumetric flow rate through the channel for a first pump setpoint. The pump setpoint for delivering the desired volumetric flow rate is determined based on previously obtained performance curves of the pump and a flow resistance of the channel. Each performance curve represents the relation between flow rate and pressure at the pump's exit for a different setpoint. The flow resistance of the channel is determined based on said first volumetric flow rate and on the performance curves of the pump.

5 Claims, 4 Drawing Sheets

(56) References Cited

U.S. PATENT DOCUMENTS

Figure 1A:
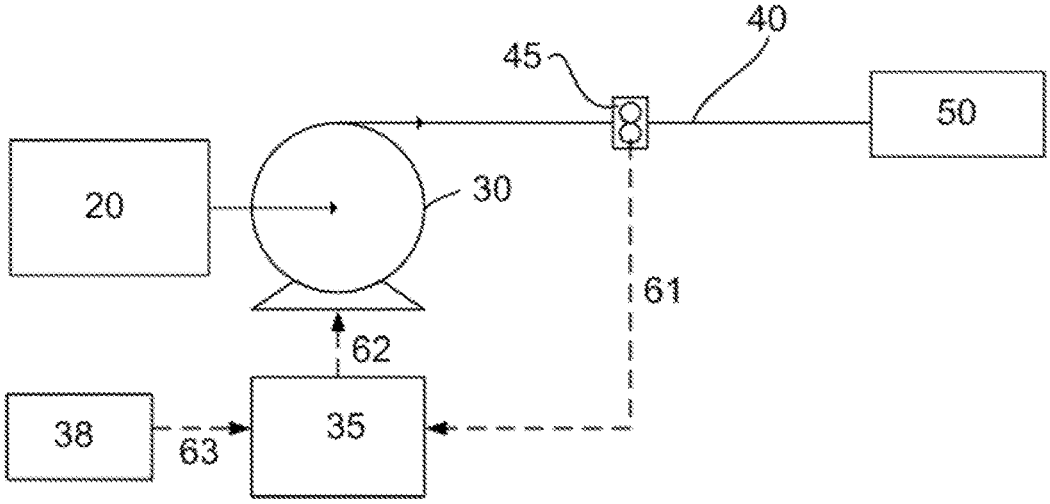

| | | | | |
|---|---|---|---|---|
| 6,346,196 | B1 | 2/2002 | Watson et al. | |
| 6,517,178 | B1 * | 2/2003 | Yamamoto et al. | 347/15 |
| 6,676,383 | B2 * | 1/2004 | Schob | F04D 15/0022 417/53 |
| 7,516,641 | B2 | 4/2009 | Lewis | |
| 7,861,740 | B2 | 1/2011 | Phallen et al. | |
| 2005/0025628 | A1 * | 2/2005 | Jones | 417/44.1 |
| 2007/0078703 | A1 * | 4/2007 | Shipley et al. | 705/11 |
| 2007/0166169 | A1 * | 7/2007 | Venkatachari et al. | 417/36 |

OTHER PUBLICATIONS

ITT Goulds Pumps. Aqua Force Pressure Boostng Sizing Guide. Jun. 2007. Technical guide.*

Johnson Controls. Fluid Flow in Piping Systems. Sep. 1989. Engineering Bulletin H110. 507 E. Michigan Street, Milwaukee, WI 53201.*

Johnson Controls. Components of Hydronic Systems. Jun. 1989. Engineering Bulletin H111. 507 E. Michigan Street, Milwaukee, WI 53201.* http://www.levitronix.com/application-notes-809.html?file=tl_files/images/fluidhandling/Documents/Application%20Notes%20New/Key%20Words/Flow%20Control/Spray%20Tool%20Applications.pdf; Feb. 17, 2009. Spray Tool Applications.

* cited by examiner

METHOD AND SYSTEM FOR DETERMINING A PUMP SETPOINT

Pumps may be used for pumping a substance, such as a slurry or a fluid (gas or liquid) through a channel from a starting point towards an end point. In this sense, many different kinds of pumps are known.

A distinction may be made between positive and non-positive displacement pumps. Positive displacement pumps produce substantially the same flow at a given speed (RPM, revolutions per minute) no matter what the discharge pressure. Irrespective of the flow resistance in the channel in which they discharge, they will provide the same volumetric flow at given RPM.

On the other hand, non-positive displacement pumps are known, e.g. velocity pumps. In velocity pumps, kinetic energy is added to the fluid by increasing the flow velocity. This increase in energy is converted to an increased pressure and/or an increased flow at the exit of the pump. These pumps do not have a constant discharge ("volume rate of flow" or "volumetric rate of flow", expressed e.g. in $m^3/s$, or $ft^3/s$) for a given pump speed. Different types of velocity pumps are known, such as e.g. centrifugal pumps, axial pumps and mixed-flow pumps.

The pumps may be driven by a suitable motor operationally connected with it. The control of the motor (and thereby the control of the pump) may be regulated e.g. in terms of a voltage or in terms of its speed (RPM). However, the discharge (volumetric rate of flow) of velocity pumps will depend not only on their drive speed, but also on the flow resistance of the channel in which they discharge.

Advantages related to velocity pumps are that they may be more reliable and generally less costly than positive displacement pumps. A disadvantage related to the use of a velocity pump is that maintaining a specific discharge can be more complicated to achieve. For example, if the channel in which the pump discharges gets clogged, or undergoes other changes, the pump setpoint (voltage or RPM) would need to be changed in order to maintain a constant flow. In applications wherein the discharge is critical, regular calibration of the pump may need to be carried out.

The process of calibration may generally be an iterative process based on trial and error. A first pump setpoint (voltage or RPM) is chosen which may be based e.g. on previous experience with the pump. The volume rate of flow in the channel may then determined. Based on the achieved volume rate of flow, the setpoint may be changed, e.g. the RPMs of the pump may be increased or decreased. After determining the volume rate of flow at the second setpoint, the setpoint may be changed once again, and so on, until the pump setpoint is found that delivers the required volume rate of flow within determined boundaries. This process may be cumbersome, especially in applications wherein the calibration needs to carried out frequently.

In methods and systems according to the examples of the present invention, the above-mentioned problem can be resolved or reduced.

Figure 1B:
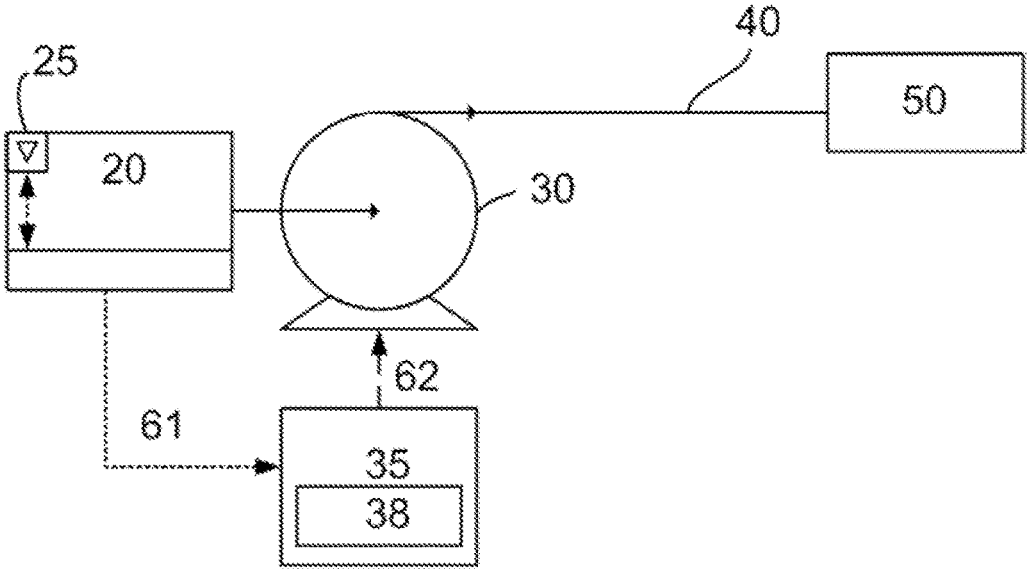
Figure 2A:
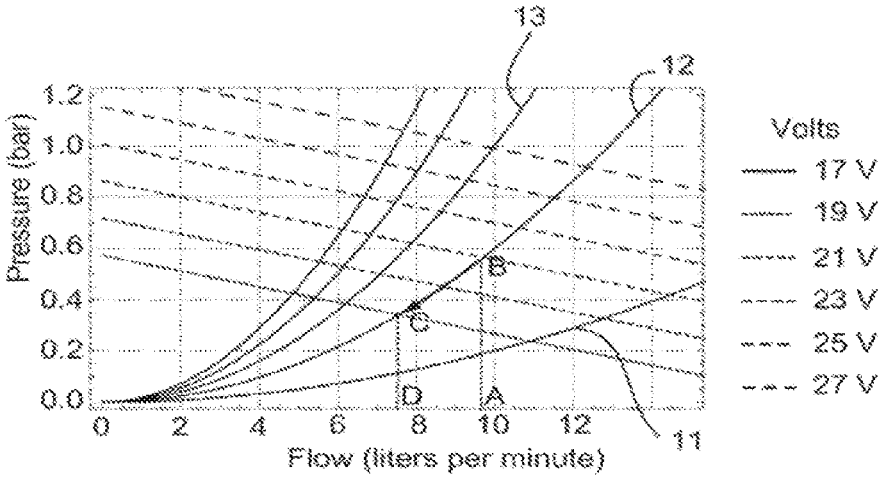
Figure 2B:
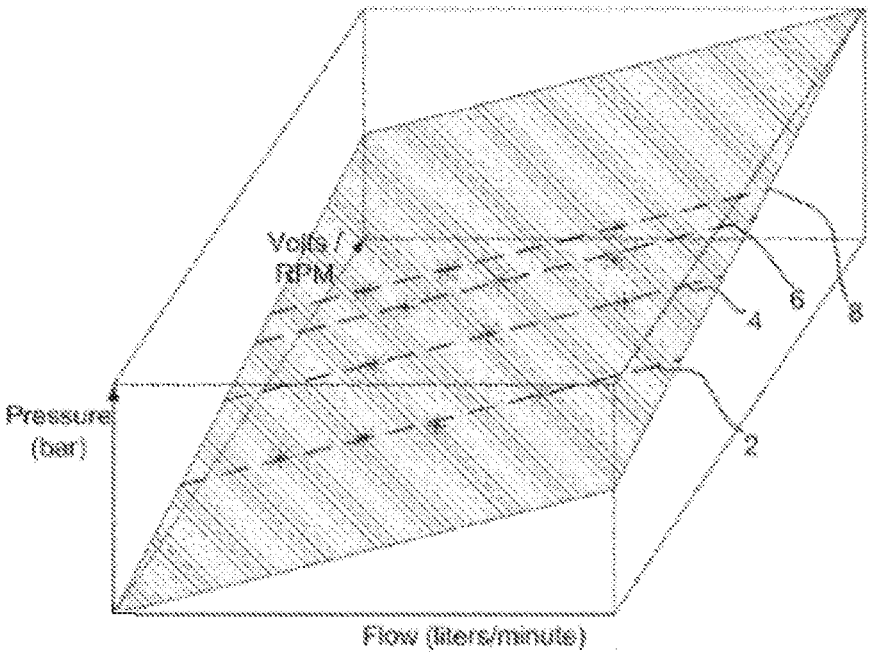
Figure 3A:
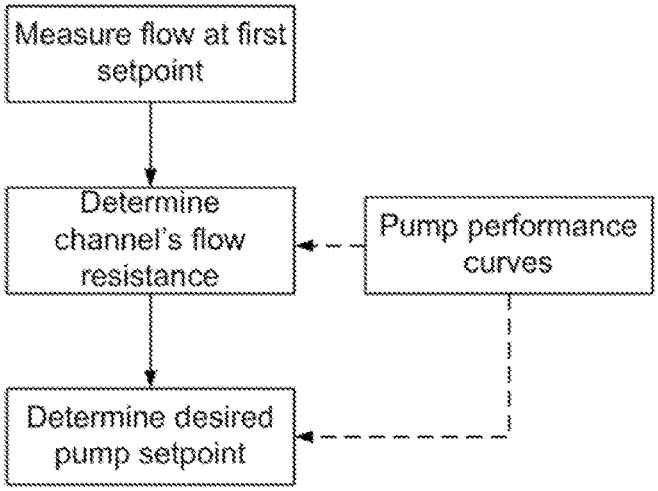
Figure 3B:
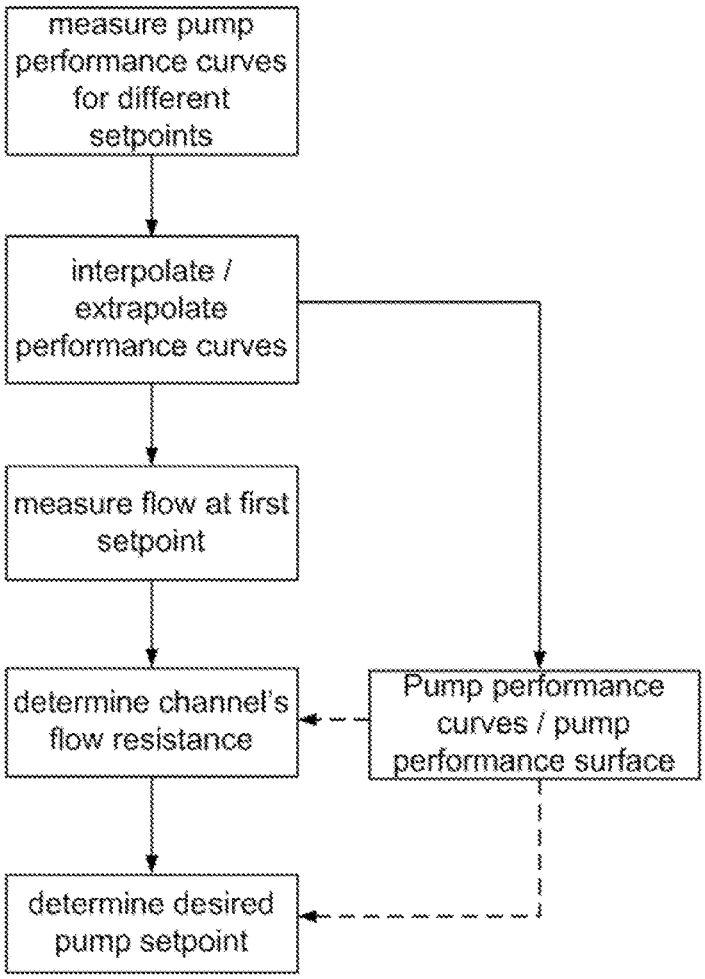
Figure 3C:
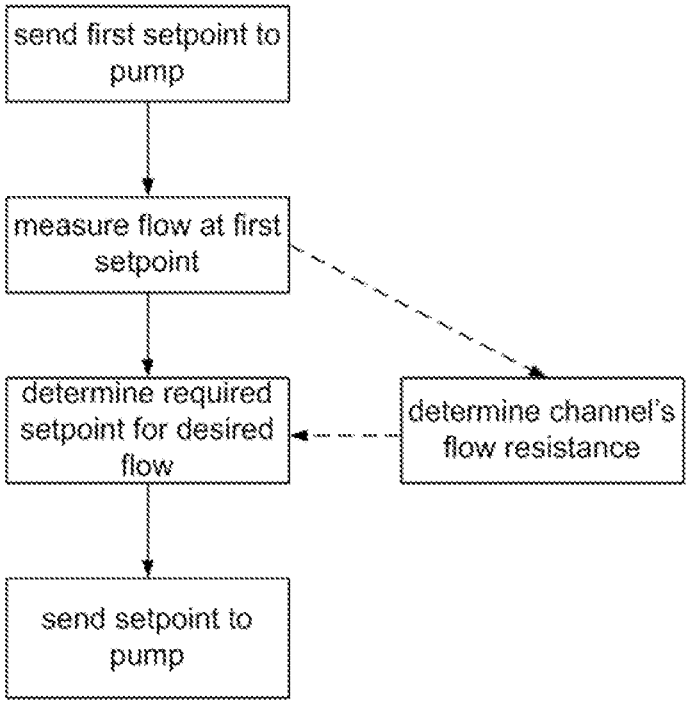

Particular examples of the present invention will be described in the following by way of non-limiting examples, with reference to the appended drawings, in which:

FIGS. 1*a* and 1*b* schematically illustrate different examples of systems incorporating a pump;

FIGS. 2*a* and 2*b* schematically illustrate examples of performance curves of a pump; and FIGS. 3*a*-3*c* schematically illustrate examples of methods of determining a pump setpoint;

FIG. 1*a* schematically illustrates a first example of a system incorporating a pump. A substance, such as e.g. a fluid, may be pumped from a reservoir 20 towards a device 50 through a channel 40. Pump 30 forces the fluid flow towards the device 50. Within the channel 40, a flow sensor 45 may be arranged for measuring the flow through the channel. If the fluid is substantially incompressible, the volumetric flow will have the same value along the length of the channel.

The pump control 35 may further be configured to send control signals 62 to the motor of the pump. These control signals may be e.g. in the form of a voltage or a speed (revolutions per minute RPM) to be applied to the motor. In response to these control signals, the pump setpoint (point of operation) may be changed or kept constant, i.e. the flow may be decreased or increased or maintained constant. The pump in this example may be a velocity pump, such as e.g. a centrifugal pump.

A flow sensor 45 may be arranged within channel 40 to determine the actual fluid flow through the channel. The measured flow may be sent as a feedback signal to the pump control 35. In an example, a repository 38 comprising performance curves of the pump may be provided. The performance curves may be stored as mathematical functions describing them. Also, a single mathematical function describing all performance curves (a pump performance surface) may be used.

The pump control 35 may consult the repository to obtain the performance curves. Based on the measured flow and these performance curves, the pump control may determine the setpoint of the pump for delivering a desired rate of flow. Examples of how to determine this setpoint will be described later with reference to the other figures. This setpoint may be sent in the form of a suitable control signal 62 to pump 30.

In an alternative example, schematically illustrated in FIG. 1*b*, no flow sensor 45 is provided in channel 40. Instead, a continuous level sensor 25 may be provided in reservoir 20. If the surface area of the reservoir is known, and the level sensor indicates the rate at which the level within the reservoir is dropping, then the flow rate through the channel may be easily calculated.

A further difference with respect to the previous example is that the repository 38 comprising performance curves of the pump is stored in a memory of the pump control 35.

Pump systems according to these examples may be incorporated in printing apparatus. One possible application of such a pump system is in a laser printing apparatus. For each individual colour (black, cyan, magenta, yellow), a pump that transfer ink from the ink tank to the Binary Ink Developer (BID) may be provided. Another possible application in a printing apparatus is a pump providing a cleaning fluid towards the Photo Imaging Plate (PIP) in order to clean and cool the PIP.

In both these applications, a predefined exact and constant amount of flow is generally required. A positive displacement pump may thus seem a logical choice for the pump. However, positive displacement pumps may be relatively costly and less reliable than e.g. centrifugal pumps. Additionally, for certain substances, such as e.g. ink composed of particles in a fluid, positive displacement pumps may not be suitable.

The use of a velocity pump (centrifugal or other) means that the volume flow provided by the pump is not automatically determined by the pump setpoint. The volume flow may thus need to be checked regularly. The channels from the ink tanks to the BID may e.g. get clogged, which could reduce the flow through the channel even though the pump works at the same setpoint.

A new pump setpoint may be determined e.g. on a daily basis. According to prior art solutions, this process may be an iterative process based on trial and error. A first pump setpoint (voltage or RPM) is chosen which may be based on previous experience with the pump. The volume rate of flow in the channel may then be determined. Based on the achieved volume rate of flow, the setpoint may be changed, e.g. the RPMs of the pump may be increased or decreased. After determining the volume rate of flow at the second setpoint, the setpoint may be changed once again, and so on, until the pump setpoint is found that delivers the required volume rate of flow within determined boundaries. This process may be cumbersome.

Improvements to this process according to several examples will be explained with reference to the following figures.

FIGS. 2*a* and 2*b* illustrate the pump performance (pressure versus flow) at different setpoints. FIG. 2*b* illustrates a pump performance surface, along three axes: the volumetric flow of the pump, the pressure at the pump's exit, and the pump setpoint in voltages or RPM. Generally, for a given setpoint, the rate of flow increases with decreasing pressure, and vice versa.

FIG. 2*a* illustrates the same performance surface, but in the form of curves for each different setpoint. These curves are cross-sections of the surface of FIG. 2*b* with planes of constant setpoint.

The performance curves, also sometimes referred to as "characteristic curves" may be obtained empirically, through standardized tests. Alternatively, they may be deduced from the pump data sheet supplied by the pump manufacturer. The performance curves show the relation between the pressure at the pump's exit and the flow rate for a given setpoint. The pressure at the pump's exit may be expressed in units of pressure or in meters of "pump head".

The pressure (P) of the pump performance surface is a function of the volume flow (Q) and the setpoint (V or RPM). In the following, the voltage will be taken as a setpoint, but it should be understood that the same reasoning could be held if speed (RPM) were chosen.

In some cases, the pressure may be linearly dependent on the voltage. If this is not the case, the performance surface may usually be very well approximated by assuming this linearity in the operational range. Thus: $P(Q,V)=f(Q)+a.V+b$, wherein f(Q) is the function expressing the relation between pressure and volume flow, and a and b are constants of the linear relation between the voltage and the pressure.

An infinite number of performance curves for an infinite number of setpoints may exist. All performance curves together may form a pump performance surface such as the one shown in FIG. 2*b*. The pump performance surface of FIG. 2*b* may be obtained by a linear interpolation and optionally an extrapolation of known performance curves 2, 4, 6 and 8. The interpolation between the known curves, and extrapolation based on the known curves makes it possible to know the performance curve for any setpoint.

In the example illustrated in FIGS. 2*a* and 2*b*, the pump pressure is not only linearly dependent on the voltage (which is often the case), but also linearly dependent on the flow. In this case $f(Q)=c.Q$, wherein c is a constant.

Assume that a desired flow rate of approximately 7.5 lpm. This desired flow rate is identified in FIG. 2A by point D. As a first attempt, assume that a first setpoint is chosen at 21V in FIG. 2A. It is thus known that the relationship between flow and voltage is given by the curve of 21 V. Because of the linear relationship in this particular case between pressure and flow, the curve in this case is a straight line.

By measuring the actual flow through the channel, the actual flow rate identified in FIG. 2A by point A can be determined. The actual flow may be measured in any suitable manner, for example in one of the two ways described in FIGS. 1*a* and 1*b*. Based on the intersection of this measurement and the curve of the first setpoint at 21 V, the operating point of the pump which is identified in FIG. 2A by point B can be determined.

Lines 11, 12 and 13, in FIG. 2A, are lines of constant resistance, and they may be expressed as $P=h.Q^2$, wherein h is the flow resistance. An infinite number of these lines of constant resistance exist. For reasons of simplicity, only a few of them are shown. The flow resistance of the channel may depend e.g. on the clogging of the line. To determine the required setpoint to deliver a desired flow volume, the flow resistance needs to be determined and taken into account.

Once the flow resistance is known, the required voltage for achieving the desired volume flow (i.e. flow at point D) can be determined without the need for any iterative process. As illustrated in FIG. 2A, by following the curve of constant flow resistance (i.e., curve 12), point C can be found as the intersection between the curve of constant flow resistance and the required setpoint for providing the desired volume flow D. The required setpoint in this example is 17 V.

In this particular example, if the flow resistance of the channel, h, were known, the pressure needed to deliver the desired flow rate could be determined by $P'=h.Q'^2$, wherein P' is the required pressure and Q' is the desired flow rate. And if the required pressure were known, the function f would need to be inverted to find the required setpoint: $f^1(Q', P')=V'$, wherein V' is the required setpoint. In the particular example shown the required voltage can be calculated as follows:

$$V' = \frac{-c - b \cdot Q + \frac{(c + b \cdot Q' + a \cdot V) \cdot Q^2}{Q^2}}{a}$$

Compared to the prior art, wherein the determination of the required setpoint is an iterative process of educated guessing, the solution according to the present example is much quicker and can be fully automated. As discussed before, these kinds of pumps may be found e.g. in components of printing apparatus wherein providing a very specific flow is critical. In these cases, the above calibration process may be carried out e.g. once a day. Every day, time can be saved in the calibration process compared with prior art methods.

However, velocity pumps such as centrifugal pumps may be found in many different applications. Whenever providing a specific flow is important, and thus whenever regular calibration is desirable, the method according to this example can be particularly beneficial.

If the relationship between pressure and flow is not linear, the equation above for determining the required setpoint may change, but the principle described before will not.

In another example, the function $P=f(Q)$ expressing the relation between pressure and volume flow may not be linear. If linear interpolation is sufficiently accurate between performance curves, then the equation: $P(Q,V)=f(Q)+a.V+b$ is still the same. Also The equation describing the relation between the flow and flow resistance does not change: $P=h.Q^2$. Solving the equations, the setpoint V' required to achieve a desired flow Q' becomes:

$$V' = \frac{-\left(\frac{Q'}{Q}\right)^2 \cdot (f(Q) + aV + b) - f(Q') - b}{a},$$

wherein Q is the flow measured at the first setpoint.

FIG. 3*a* illustrates an example of the principle illustrated so far: a first setpoint may be chosen and the flow for said first setpoint may be measured. The channel's flow resistance at that given moment may be determined based on the measured flow and based on previously obtained pump performance curves, each performance curve, describing the relation between pressure and volume flow for a given setpoint. If the channel's flow resistance is known, the required pump setpoint for delivering the desired volume flow can be directly determined based on the pump's performance curves and the channel's flow resistance.

The channels' flow resistance may be determined only implicitly, i.e. it is not necessary to first explicitly determine the channel's flow resistance and then determine the required pump setpoint based on this flow resistance. Rather, the mathematical equation describing the relation between the flow resistance, pressure and the flow through the channel may be implicitly used in solving the mathematical equation giving the required setpoint, in a manner similar to what was shown in the previous examples.

In some examples, the pump performance curves may be delivered by the pump manufacturer in the form of a pump datasheet. Such a method is schematically illustrated in FIG. 3*b*. Alternatively, before the described calibration process, the pump's performance curves may be experimentally established using standardized tests. The performance curves may be described as mathematical equations governing the relationship between pressure and flow for a given setpoint. The performance curves however only need to be established once. After that, there is no need to repeat to repeat this process.

In the example of FIG. 3*b*, after measuring a plurality of performance curves for different setpoints, interpolation may be performed to obtain performance curves for other setpoints. Depending on the chosen setpoints during, also extrapolation from the known performance curves may be used. The performance curves are thus defined for any given setpoint. A pump performance surface such as the one shown in FIG. 2*b* may thus be defined.

Based on the pump performance curves (or on the pump performance surface), the channel's flow resistance can be determined. If the channel flow resistance is known, the required setpoint to deliver a desired volume flow may be easily determined. Also, in this case, the flow resistance of the channel need not be determined explicitly.

FIG. 3*c* schematically illustrates an example of a control method implemented in the pump control. A first setpoint may be sent to the pump. This first setpoint may be chosen randomly, or may e.g. be based on previous experience with the same pump. Then, the measured flow may be received from a sensor. The pump control may determine the channel's flow resistance based on the measured flow and the pump's performance curve for the first setpoint, and the required pump setpoint may be determined as shown before. Finally, this required pump setpoint may be sent to the pump. Similarly as mentioned before, the channel's flow resistance may be determined explicitly, and the flow resistance may then be used in the determination of the required setpoint. Or, alternatively, the flow resistance is not explicitly determined, and only taken into account implicitly.

The pump control may incorporate a computing apparatus having a memory comprising computer readable instructions for carrying out the above process.

In an example, a computer program product may be provided, adapted for putting the explained methods into practice. The program may be in the form of source code, object code, a code intermediate source and object code such as in partially compiled form, or in any other form suitable for use in the implementation of the methods. The carrier may be any entity or device capable of carrying the program.

For example, the carrier may comprise a storage medium, such as a ROM, for example a CD ROM or a semiconductor ROM, or a magnetic recording medium, for example a floppy disc or hard disk. Further, the carrier may be a transmissible carrier such as an electrical or optical signal, which may be conveyed via electrical or optical cable or by radio or other means.

Although only a number of particular embodiments and examples of the invention have been disclosed herein, it will be understood by those skilled in the art that other alternative embodiments and/or uses of the invention and obvious modifications and equivalents thereof are possible. Furthermore, the present invention covers all possible combinations of the particular embodiments described. Thus, the scope of the present invention should not be limited by particular embodiments, but should be determined only by a fair reading of the claims that follow.

The invention claimed is:

1. A system for determining a desired pump setpoint for delivering a desired volumetric flow rate of a substance from a pump through a channel, comprising a sensor for determining a volumetric flow rate of the substance through the channel when driven by the pump, a data repository comprising a plurality of performance curves of the pump for different setpoints, each performance curve representing a relation between volumetric flow rate and pressure at an exit of the pump for different setpoints, and a pump controller configured to send a first pump setpoint to the pump, to receive from the sensor the volumetric flow rate at said first pump setpoint, to determine a value for flow resistance of the channel based on the performance curve of the pump at the first pump setpoint, determine the desired pump setpoint for delivering the desired volumetric flow rate based on the determined flow resistance value of the channel and to send the desired pump setpoint for the desired volumetric flow rate to the pump.

2. The system according to claim 1, wherein the sensor is a flow sensor arranged within the channel.

3. The system according to claim 1, wherein the sensor is a level sensor arranged in a reservoir from which the substance is delivered to the pump, wherein change in a level of the substance in the reservoir is used for determining a volumetric flow rate of the substance through the channel.

4. The system according to claim 1, wherein the data repository is incorporated in the pump controller.

5. A printing apparatus comprising a system according to claim 1.

* * * * *